US009144308B2

(12) United States Patent
Nakagaki

(10) Patent No.: US 9,144,308 B2
(45) Date of Patent: Sep. 29, 2015

(54) IMAGE FORMING APPARATUS

(71) Applicant: Canon Kabushiki Kaisha, Tokyo (JP)

(72) Inventor: Jun Nakagaki, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/724,250

(22) Filed: Dec. 21, 2012

(65) Prior Publication Data

US 2013/0195503 A1 Aug. 1, 2013

(30) Foreign Application Priority Data

Jan. 31, 2012 (JP) ..... 2012-018914

(51) Int. Cl.

| | |
|---|---|
| ***G03G 15/00*** | (2006.01) |
| ***A47B 91/02*** | (2006.01) |
| ***G03G 21/16*** | (2006.01) |

(52) U.S. Cl.

CPC ..... *A47B 91/02* (2013.01); *G03G 21/1619* (2013.01)

(58) Field of Classification Search

None

See application file for complete search history.

(56) References Cited

U.S. PATENT DOCUMENTS

| | | | | |
|---|---|---|---|---|
| 5,131,621 | A * | 7/1992 | Sdano | 248/680 |
| 5,247,316 | A * | 9/1993 | Komori et al. | 347/137 |
| 5,666,595 | A * | 9/1997 | Sameshima et al. | 399/110 |
| 6,427,966 | B1 * | 8/2002 | Blumenschein | 248/678 |
| 6,473,152 | B1 * | 10/2002 | Yokota | 355/30 |
| 7,300,148 | B2 * | 11/2007 | Elenes | 347/108 |
| 7,577,376 | B2 * | 8/2009 | Kobayashi | 399/107 |
| 7,590,378 | B2 * | 9/2009 | Fuchs et al. | 399/384 |
| 8,503,168 | B2 | 8/2013 | Souda et al. | |
| 8,867,197 | B2 | 10/2014 | Souda et al. | |
| 2005/0208843 | A1 | 9/2005 | Kobayashi | |
| 2013/0112822 | A1 * | 5/2013 | Ishiwata | 248/188.8 |
| 2013/0180187 | A1 * | 7/2013 | Takeshita et al. | 52/167.8 |
| 2014/0001696 | A1 * | 1/2014 | Yoshida | 271/9.01 |
| 2014/0167580 | A1 * | 6/2014 | Funayama et al. | 312/237 |

FOREIGN PATENT DOCUMENTS

CN 102053550 A 5/2011

(Continued)

OTHER PUBLICATIONS

Translation of JP2011224986.*

(Continued)

*Primary Examiner* — Clayton E Laballe
*Assistant Examiner* — Ruifeng Pu
(74) *Attorney, Agent, or Firm* — Fitzpatrick, Cella, Harper & Scinto

(57) ABSTRACT

An image forming apparatus includes: a first unit including an image forming unit for forming an image on a recording material; a first supporting portion for supporting the first unit at three points consisting of a first foot provided adjacent to a side of a bottom of the first unit, a second foot, and a third foot provided adjacent to an opposite side of the bottom; a second unit provided below the first unit; a second supporting portion, provided at a bottom of the second unit, for supporting the second unit by at least four foots; and a connecting portion for connecting the first unit and the second unit with respect to an up-down direction so that the opposite side of the bottom of the first unit is inclined depending on inclination of the side of the bottom of the first unit with respect to a horizontal surface.

12 Claims, 10 Drawing Sheets

(56) References Cited

FOREIGN PATENT DOCUMENTS

| | | | |
|---|---|---|---|
| JP | 2000-330351 | A | 11/2000 |
| JP | 2002-287452 | A | 10/2002 |
| JP | 2008-090122 | A | 4/2008 |
| JP | 2011-224986 | A | 11/2011 |
| JP | 2011224986 | * | 11/2011 |

OTHER PUBLICATIONS

Translation of JP2000330351.*
JP2011224986.*
Howstuffworks.com, Home-Repair Materials Basics.*
Chinese Office Action issued in Chinese Application No. 201310031181.X, dated Dec. 31, 2014.

* cited by examiner (a)

(b)

IMAGE FORMING APPARATUS

FIELD OF THE INVENTION AND RELATED ART

The present invention relates to an image forming apparatus including an image forming portion for forming an image on a recording material, a first unit supported at three points, and a second unit which is provided below the first unit with respect to a direction of gravitation and which is supported at least at four points.

In the image forming apparatus having four or more foots (disposing points) which contact a disposing surface (e.g., a floor or desk), when flatness of the disposing surface on which a main assembly of the image forming apparatus is disposed is poor, there is a problem such that a frame of the apparatus main assembly is distorted to deteriorate geometrical accuracy of the image to be outputted on the recording material.

This frame distortion is generated, in the case where either one of four feet is floating due to poor flatness of the disposing surface although it is assumed that a load is received uniformly at the four feet, by the load exerted from other three points on the frame. It is difficult to predict as to what one of the four feet provided on the main assembly will float from the disposing surface since the floating state depends on a state of the disposing surface.

On the other hand, it has been known a constitution such that by providing three feet to the main assembly (hereinafter referred to as a three-point supporting type), even when the flatness of the floor or the desk at the disposing portion is poor, a degree of the distortion of the frame of the image forming apparatus main assembly can be reduced.

Separately, it would be considered that an extension unit such as a sheet feeding unit is provided below the image forming apparatus of the three-point supporting type and is used as an image forming system.

In many cases, the extension unit is provided with four or more feet (including casters) in view of importance of stability thereof with respect to the disposing surface. Assuming the case where the system is integrally slid and moved on the disposing surface by the casters, it is desirable that the image forming apparatus and the extension unit are clamped with a screw or the like so as not to be separated from each other.

Thus, in the case where the image forming apparatus and the extension unit are clamped with the screw or the like, a constitution in which the image forming apparatus and the extension unit are clamped with screws in the neighborhood of all of the supporting points (the three points in the three-transfer supporting type) of the image forming apparatus has been known (Japanese Laid-Open Patent Application (JP-A) 2000-330351). However, when the image forming apparatus of the three-point supporting type is mounted on the extension unit provided with at least four feet and these members are clamped in the neighborhood of all of the supporting points, the following problem arose.

Specifically, in the case where the extension unit is provided with four or more feet, depending on the flatness of the disposing surface, the frame of the extension unit is distorted. When the distorted extension unit and the image forming apparatus are clamped at three points or more, due to the distortion of the extension unit, a force is exerted on the frame of the image forming apparatus, so that there was a possibility that the frame is distorted.

That is, in the image forming system consisting of the extension unit and the image forming apparatus main assembly, the distortion of the apparatus main assembly frame resulting from the distortion of the extension unit was not able to be suppressed while clamping the extension unit and the image forming apparatus main assembly so as not to be easily separated from each other.

SUMMARY OF THE INVENTION

A principal object of the present invention is to provide an image forming apparatus having solved the above problem of the conventional image forming apparatus.

According to an aspect of the present invention, there is provided an image forming apparatus comprising: a first unit including an image forming unit for forming an image on a recording material; a first supporting portion for supporting the first unit at three points consisting of a first foot provided adjacent to a side of a bottom of the first unit, a second foot, and a third foot provided adjacent to an opposite side of the bottom of the first unit; a second unit provided below the first unit with respect to a direction of gravitation; a second supporting portion, provided at a bottom of the second unit, for supporting the second unit by at least four foots; and a connecting portion for connecting the first unit and the second unit with respect to an up-down direction so that the opposite side of the bottom of the first unit is inclined depending on inclination of the side of the bottom of the first unit with respect to a horizontal surface.

These and other objects, features and advantages of the present invention will become more apparent upon a consideration of the following description of the preferred embodiments of the present invention taken in conjunction with the accompanying drawings.

Figure 2:
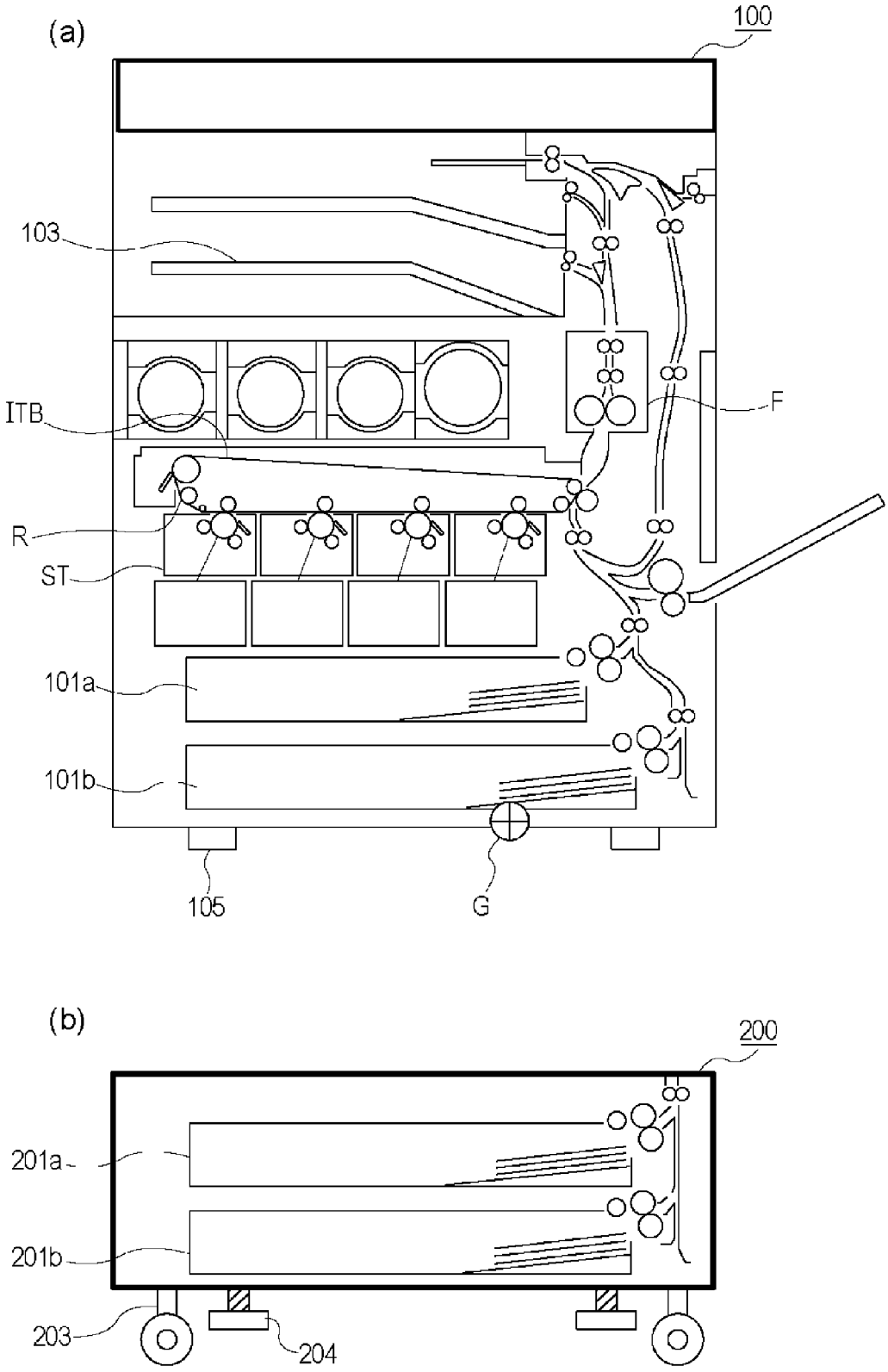

Parts (*a*) and (*b*) of FIG. 2 are schematic sectional views of the image forming system.

Figure 3:
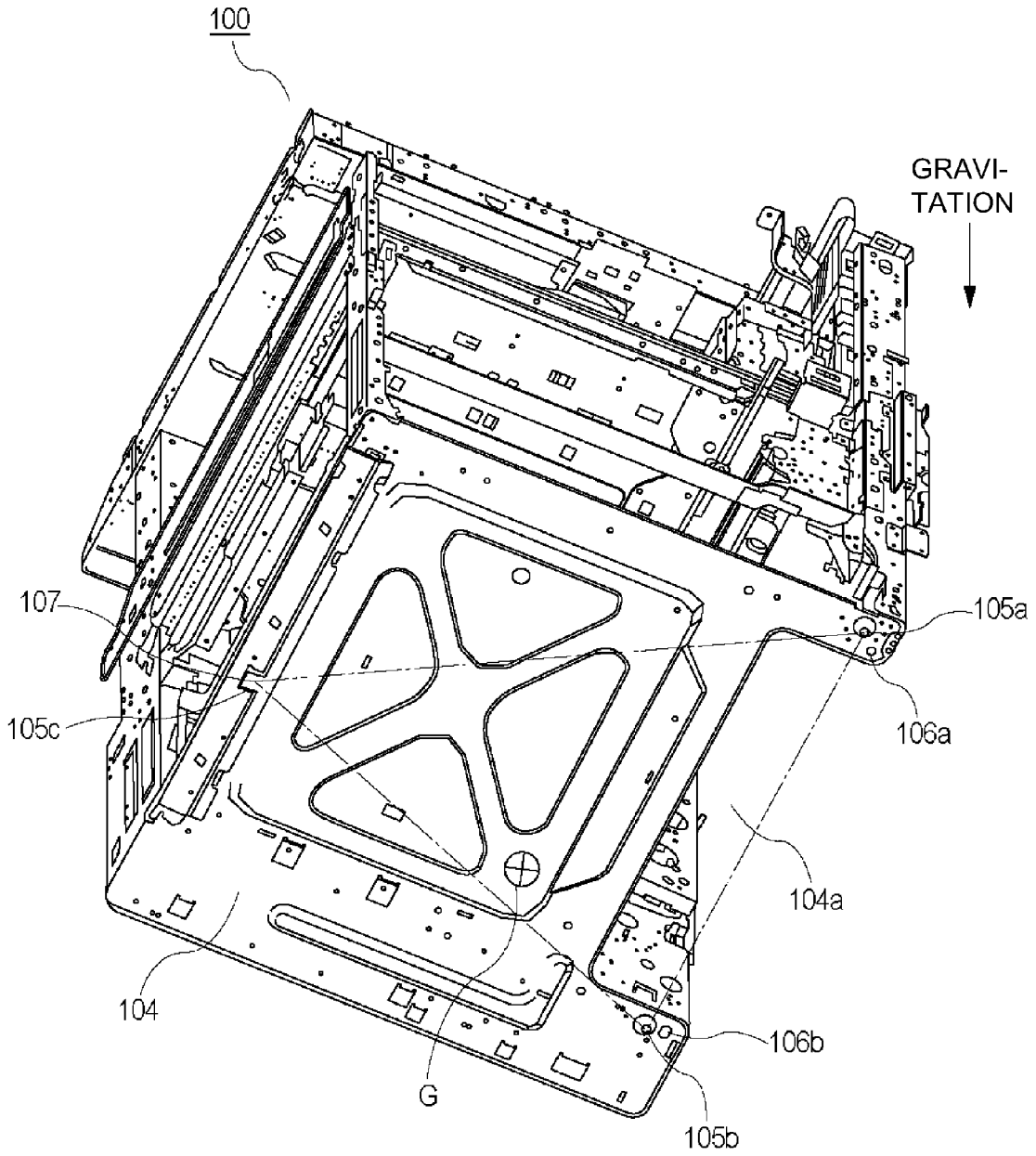

FIG. 3 is a perspective view of a frame of a printer according to Embodiment 1.

Figure 4:
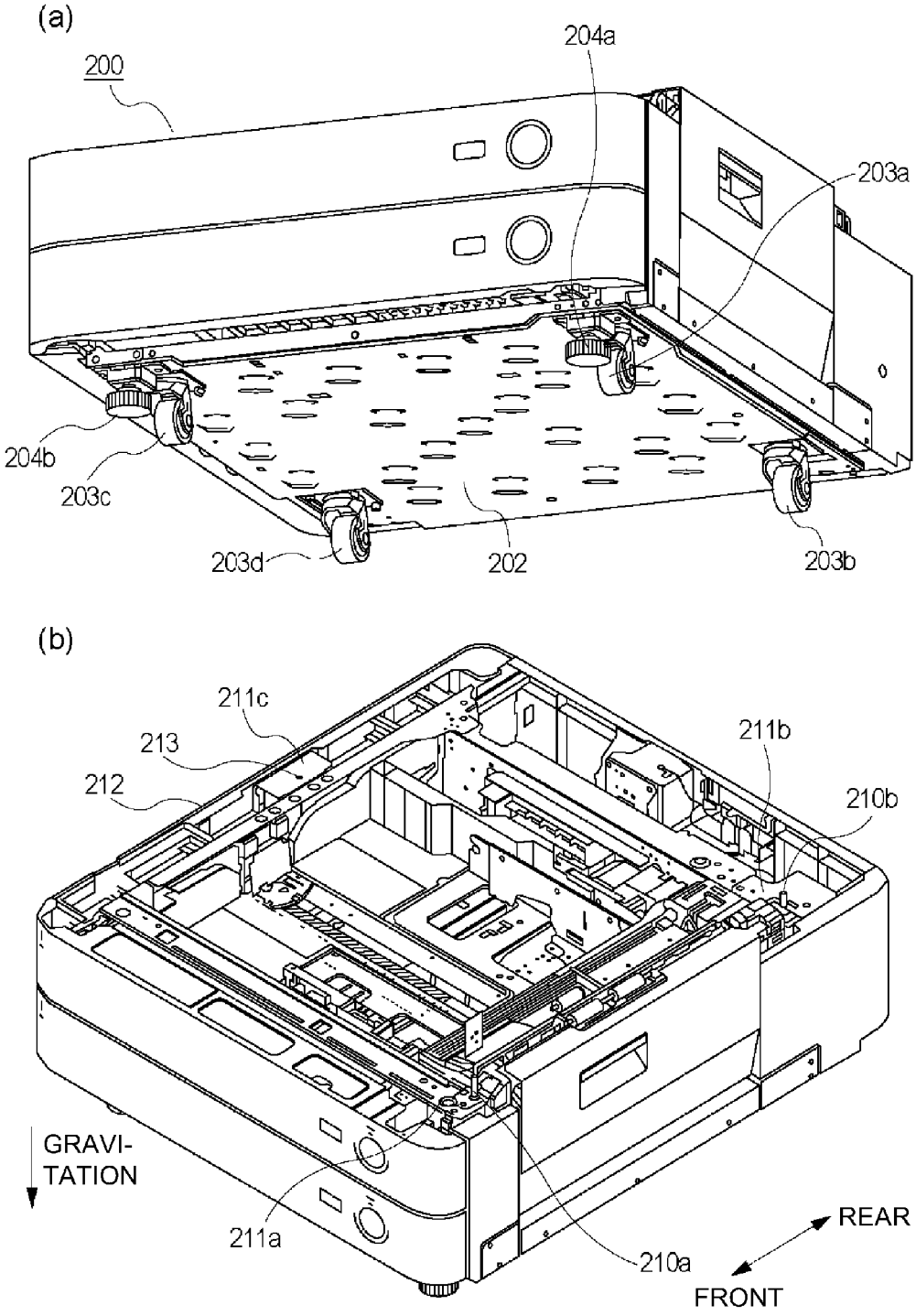

Parts (*a*) and (*b*) of FIG. 4 are perspective views of a sheet feeding unit in Embodiment 1.

Figure 5:
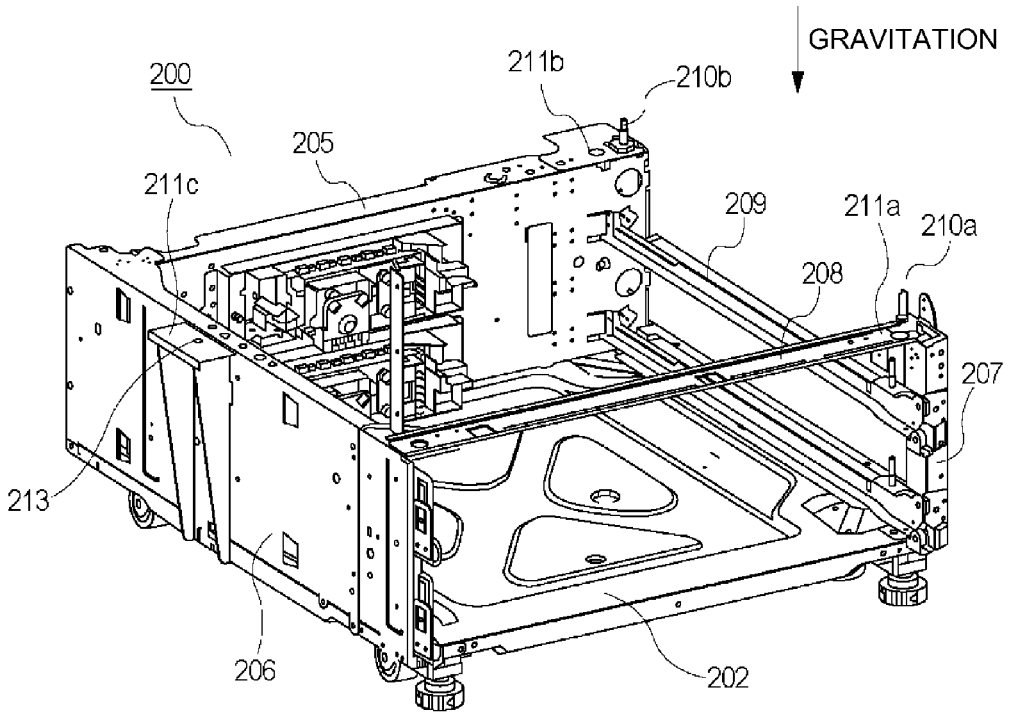

FIG. 5 is a perspective view of a frame of the sheet feeding unit in Embodiment 1.

Figure 6:
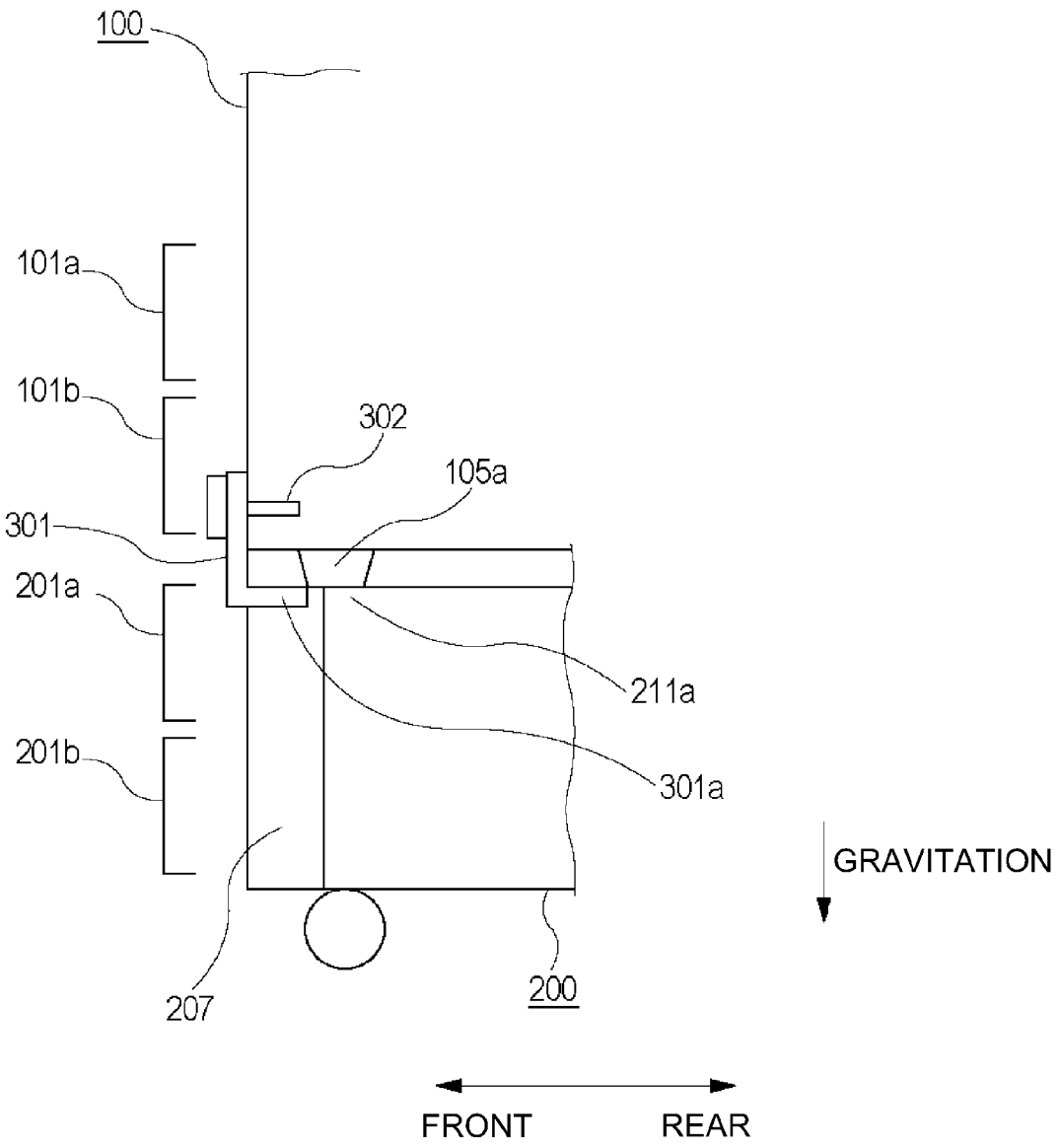

FIG. 6 is an enlarged view of a connecting portion (clamping plate) between the printer and the sheet feeding unit in Embodiment 1.

Figure 7:
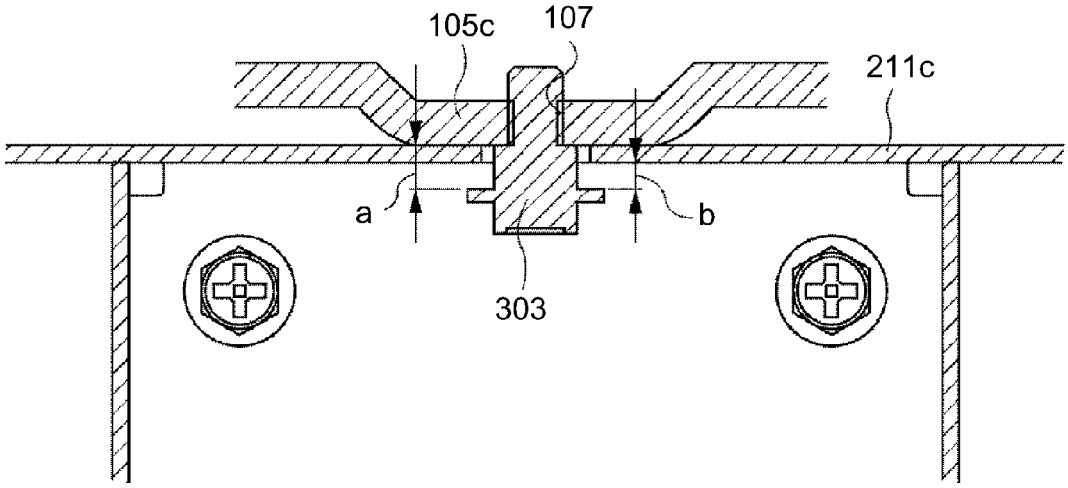
Figure 7:
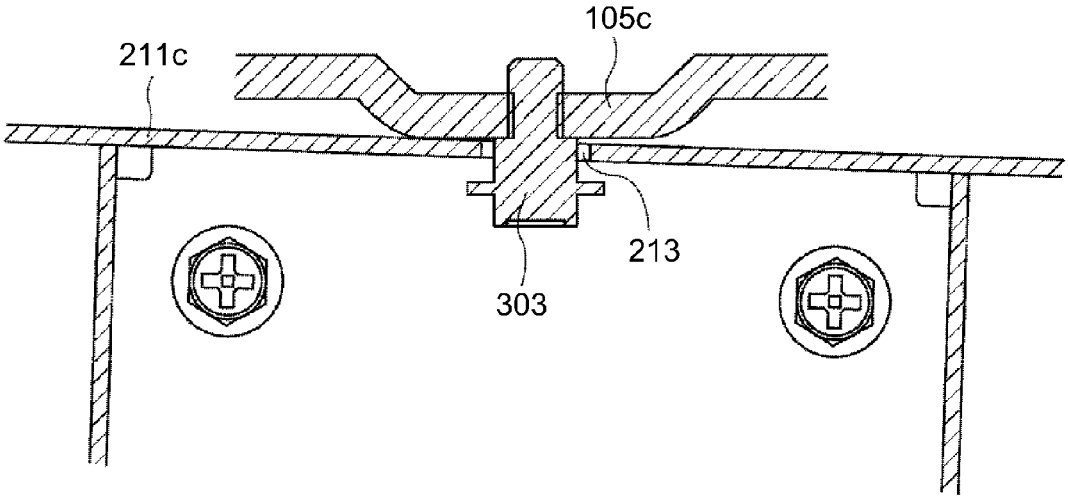

Parts (*a*) and (*b*) of FIG. 7 are enlarged views of the connecting portion (clamping plate) between the printer and the sheet feeding unit in Embodiment 1.

Figure 8:
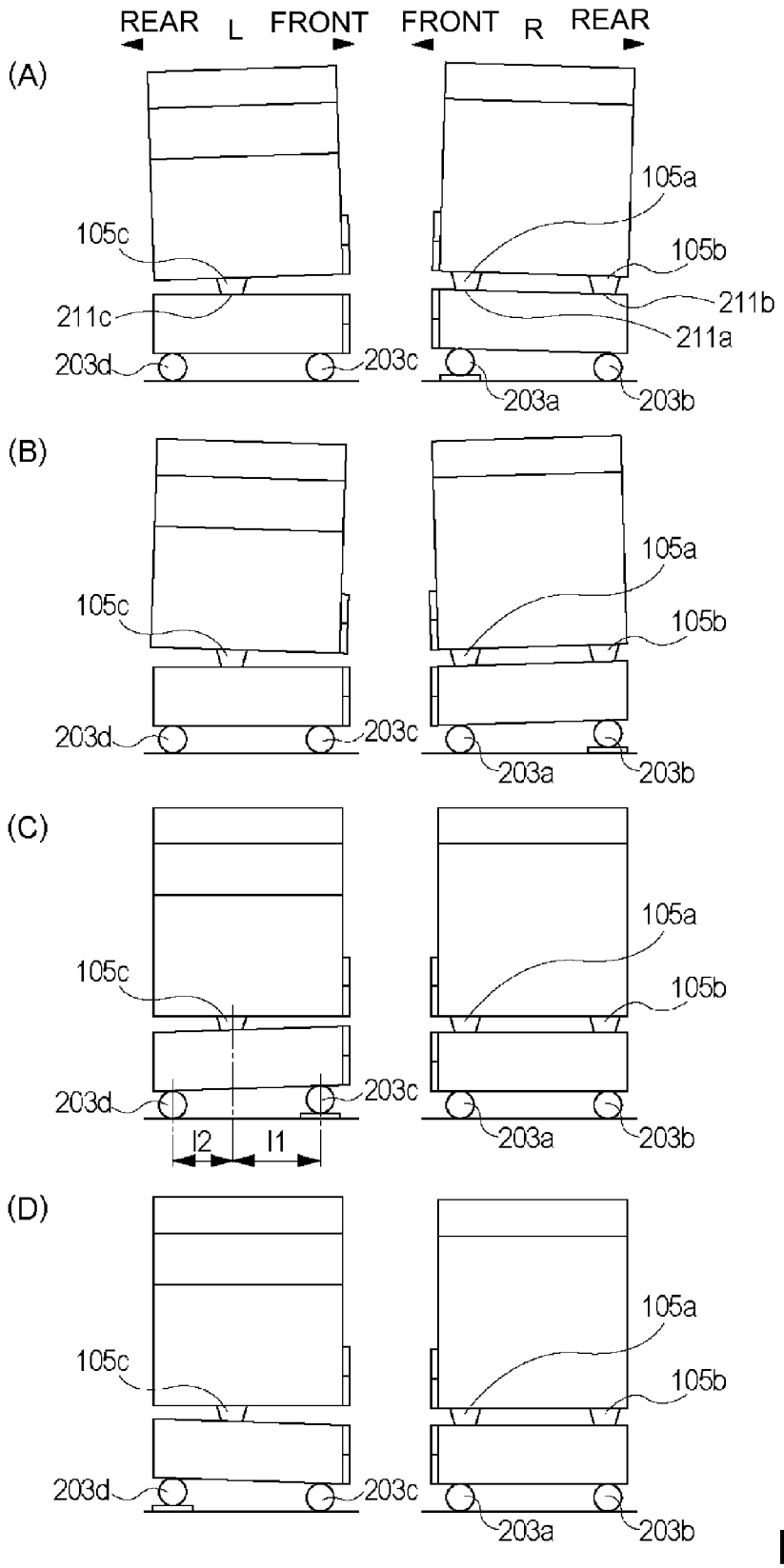

Parts (A) to (D) of FIG. 8 are schematic sectional views each for illustrating an attitude of the system when there are non-parallel disposing surfaces.

Figure 9:
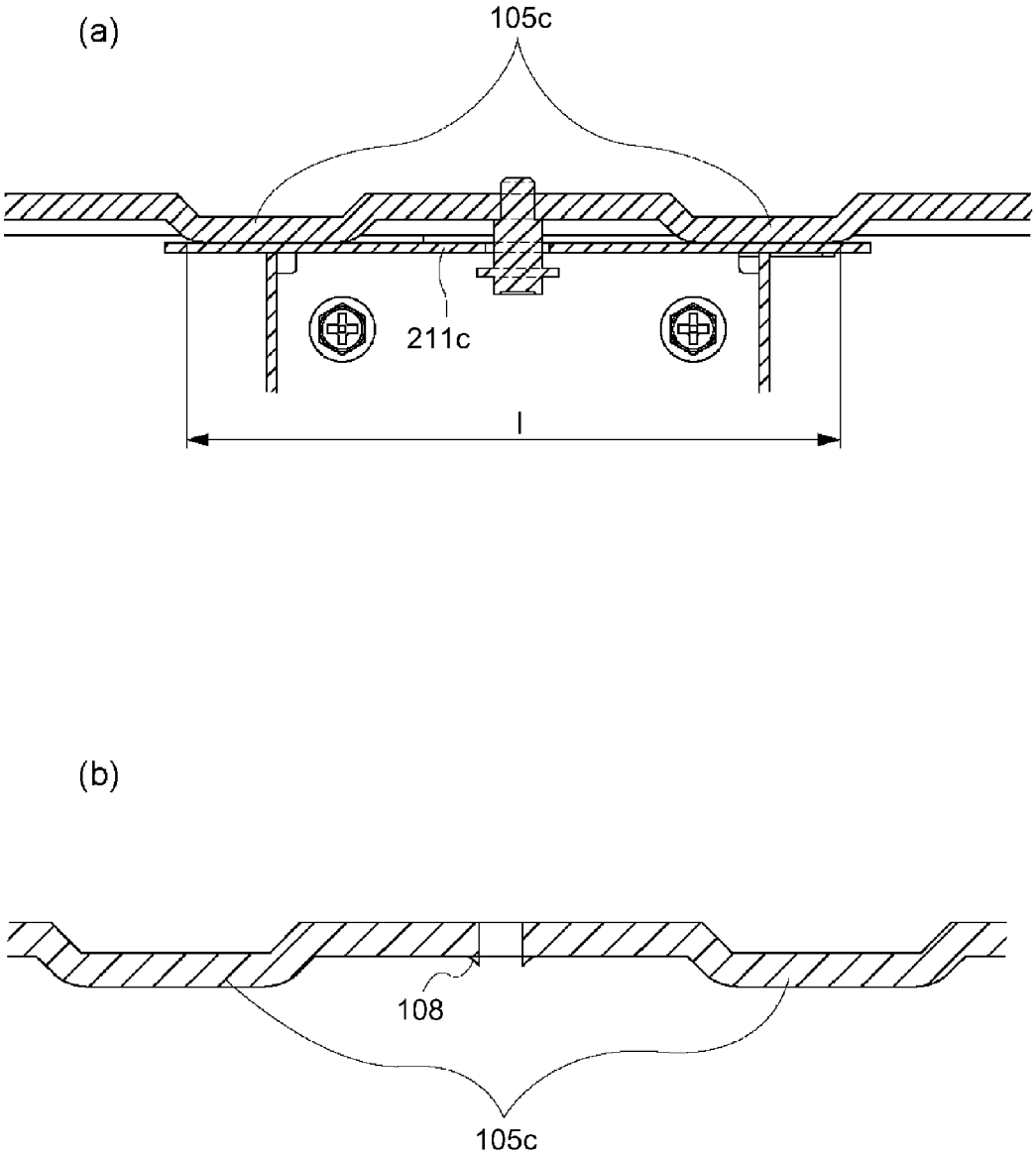

Parts (*a*) and (*b*) of FIG. 9 are enlarged view of a clamping plate in Embodiment 2.

Figure 10:
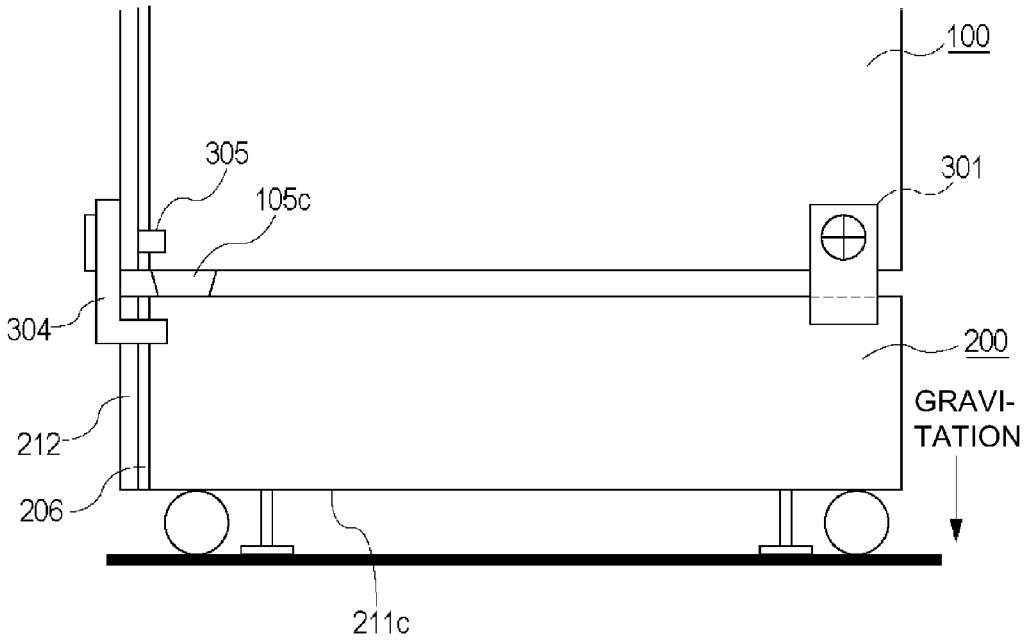

FIG. 10 is a schematic sectional view for illustrating a clamped state of an image forming system according to Embodiment 3.

DESCRIPTION OF THE PREFERRED EMBODIMENTS

An image forming system consisting of an image forming apparatus and an extension unit will be specifically described with reference to the drawings. Incidentally, with respected to dimensions, materials, shapes, relative arrangements and the like of constituent elements of the image forming system, the scope of the present invention is not limited to those described in the following embodiments unless otherwise specified.

First, a general structure of the image forming system will be briefly described with reference to a perspective view. Then, a printer 100 as the image forming apparatus and a sheet feeding unit 200 as the extension unit will be described and thereafter clamping between the printer 100 and the sheet feeding unit 200 will be specifically described.

1. Structure of Image Forming System (Summary of Image Forming System)

Figure 1:
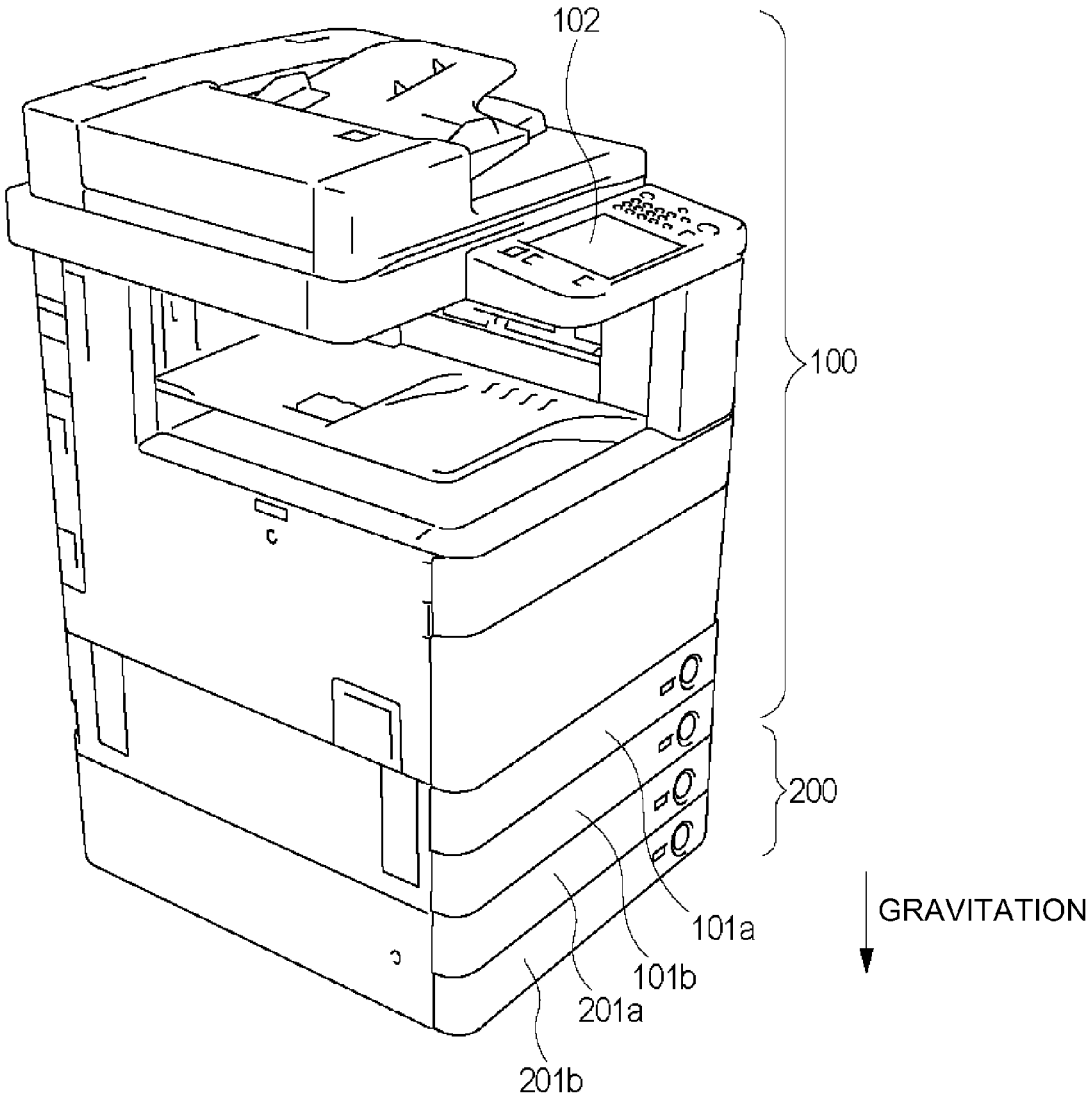
FIG. 1 is a perspective view of an image forming system.

FIG. 1 is a perspective view for illustrating the general structure of the image forming system according to this embodiment.

The printer 100 as the image forming apparatus is mountable above (on) the sheet feeding unit 200 as the extension unit with respect to the direction of gravitation.

The printer main assembly and the sheet feeding unit include two-tired sheet-feeding cassettes 101*a* and 101*b*, and 201*a* and 201*b*, respectively. In the respective sheet-feeding cassettes, sheets of recording materials different in size and basis weight are set, so that it is possible to select the recording material, to be used, through an operating portion 102 and a personal computer (not shown) or the like connected with the printer main assembly.

The image forming apparatus main assembly includes an image forming portion, and when a frame (first frame) for supporting the image forming portion is distorted, image defect is generated in some cases. On the other hand, even when a frame (second frame) of the sheet feeding unit is distorted, the sheet feeding unit does not adversely affect a function of feeding the recording material and delivering the recording material to the image forming apparatus main assembly via an opening. In this embodiment, stainless steel was used for the printer 100 and the sheet feeding unit 200.

(Image Forming Apparatus: Printer)

Part (*a*) of FIG. 2 shows a cross-section of the printer 100.

The recording material fed from the sheet-feeding cassette 110*a* or 101*b* is conveyed in a right side of the apparatus in a substantially vertical (up-down) direction. Each image forming portion ST includes a photosensitive drum as a photosensitive member, a develop means for developing an electrostatic latent image, formed on the photosensitive drum (photosensitive member), into a toner image, and the like means. Further, the toner image which is formed at the image forming portion ST and which is then transferred on an intermediary transfer belt ITB as an intermediary transfer member is transferred onto the recording material, fixed on the recording material by a fixing device F, and then is discharged from a sheet-discharging port 103. The intermediary transfer belt ITB is stretched by a plurality of stretching rollers, and the toner image conveyed by the belt is transferred onto the recording material at a transfer position.

FIG. 3 is a perspective view of the printer 100 as seen from below the printer 100 with respect to the direction of gravitation. As shown in FIG. 3, in a right side of a bottom plate 104 of the image forming apparatus main assembly, a conveying path 104*a* is provided. This conveying path is provided for delivering the recording material from the sheet feeding unit to the image forming apparatus main assembly when the sheet feeding unit is connected with the image forming apparatus main assembly.

At the bottom of the bottom plate 104, three supporting portions 105*a* (first disposing point), 105*b* (second disposing point) and 105*c* (third disposing point) are provided (FIG. 3). The supporting portions 105*a* and 105*b* (first disposing point and second disposing point) are provided in the neighborhood of a front-right corner of the bottom plate and in the neighborhood of a rear-right corner of the bottom plate, respectively, so as to sandwich the conveying path 104*a*. Further, the supporting portion 105*c* (third disposing point) is provided in the neighborhood of a central portion of a left end portion of the bottom plate so that the center of gravity G of the image forming apparatus main assembly is located inside lines connecting the three supporting portions 105*a* to 105*c*.

In the image forming apparatus main assembly, a driving portion and an electrical equipment portion which are heavy objects are located in a main assembly rear side and a conveying portion is located in a main assembly right side, and therefore the position of the center of gravity G is located closest to the rear-right-side supporting portion 105*b* (second supporting portion (disposing point) of the three supporting portions 105*a* to 105*c*. On the other hand, the supporting portion remotest from the center of gravity G is the supporting portion 105*a* (first supporting portion disposing point).

The main assembly left side supporting portion 105*c* (third supporting portion) is provided with a tap 107 which is a cut-away portion. The tap 107 is provided in the neighborhood of (within a radius of 5 cm from the third supporting portion as the center) the supporting portion 105*c*.

In the case where the image forming apparatus main assembly is disposed alone, the image forming apparatus main assembly is seated at the three supporting portions 105*a* to 105*c* and therefore an attitude of the bottom plate 104 is uniquely determined. Therefore, even in the case where flatness of a disposing place of the image forming apparatus main assembly is poor, distortion is not readily generated in the frame for supporting the image forming portion.

Further, the bottom plate 104 is provided with two positioning holes 106*a* and 106*b* in the neighborhood of the front-right corner thereof and in the neighborhood of the rear-right corner thereof, respectively, so as to sandwich the conveying path 104*a*. The positioning hole 106*a* in the neighborhood of the front-right corner is a circular hole, and the positioning hole 106*b* in the neighborhood of the rear-right corner is an elongated extending toward the positioning hole 106*a*. These positioning holes are, as described later, used for positioning the image forming apparatus main assembly and the sheet feeding unit. The positioning hole 106*a* is disposed in the neighborhood of the supporting portion 105*a*, and the positioning hole 106*b* is disposed in the neighborhood of the supporting portion 105*b*.

(Extension Unit: Sheet Feeding Unit)

Part (*b*) of FIG. 2 shows a cross-section of the sheet feeding unit 200 for feeding the sheets to the printer 100. The sheet feeding unit 200 includes the sheet-feeding cassette 201*a* in which the sheets of the recording material are accommodated and the sheet-feeding cassette 201*b* as a sheet accommodating portion. The sheet accommodated in each of the sheet-feeding cassettes is conveyed through the conveying path in the apparatus right side to the printer main assembly connected with the sheet feeding unit. Further, the sheet feeding unit 200 is provided with casters 203*a* to 203*d* for permitting sliding movement thereof on the disposing surface, and adjusters 204*a* and 204*b* which are foots provided adjustably in height.

Part (*a*) of FIG. 4 is a perspective view of the sheet feeding unit 200 as seen from below the sheet feeding unit 200, and (*b*) of FIG. 4 is a perspective view of the sheet feeding unit 200 as seen from above the sheet feeding unit 200. FIG. 5 is a perspective view for illustrating a frame of the sheet feeding unit 200 from which an outer casing plate is removed.

As shown in (*a*) of FIG. 4, on a bottom plate 202 of the sheet feeding unit 200, the casters 203*a* to 203*d* as disposing portions are mounted in the neighborhoods of four corners of the bottom plate 202. Further, in the neighborhoods of the front-side two casters 203*a* and 203*c*, the adjusters 204*a* and 204*b* are provided, respectively. After the apparatus is seated, each of the adjusters is rotated to be lowered to be seated on the floor (horizontal surface), so that it is possible to prevent the apparatus from being moved unintentionally.

Further, on the bottom 202 of the sheet feeding unit 200, a rear side plate 205, a left side plate 206 and a front-right (support) strut 207 are uprighted (FIG. 5). The front-right strut 207 and the left side plate 206 are connected by a stay 208. Further, the front-right strut 207 and the rear side plate 205 are connected by a stay 209.

Thus, at the four corners of the frame, the side plates or the strut is disposed and therefore the frame of the sheet feeding unit is configured so that it has a high compressive strength with respect to the up-down direction but stiffness in torsion is not so high.

In the neighborhoods of the front-right corner and the rear-right corner of a frame top surface of the sheet feeding unit 200, two positioning pins 210*a* and 210*b* are provided, respectively, so as to sandwich a recording material delivering portion. Further, in the neighborhoods of the front-right corner, the rear-right corner and a left side surface central portion of the top surface of the sheet feeding unit 200, receiving portions 211*a*, 211*b* and 211*c* for receiving the image forming apparatus main assembly are provided, respectively.

An apparatus width of the sheet feeding unit 200 including its outer casing is the same as an apparatus width of the image forming apparatus main assembly including its outer casing (FIG. 1). On the other hand, a frame width of the sheet feeding unit 200 is narrower than a frame width of the image forming apparatus main assembly. Further, the receiving portion 211*c* of the sheet feeding unit 200 is disposed so as to be protruded from the left side plate 206 toward the outside of the left side of the apparatus. That is, when a left cover 212 of the sheet feeding unit 200 is removed, the receiving portion 211*c* is exposed. Further, the left-side receiving portion 211*c* of the sheet feeding unit 200 is provided with a screw hole 213.

2. Clamping Between Printer and Sheet Feeding Unit

A clamping structure between the printer 100 and the sheet feeding unit 200 as the extension unit will be specifically described. First, positioning between the printer 100 and the sheet feeding unit 200 will be described. Then, a connecting portion between the printer 100 and the sheet feeding unit 200 will be specifically described. In this embodiment, a clamped state refers to a state in which objects are connected by a clamping (connecting) means such as a screw with no clearance (play) so as not be moved relative to each other. Further, a connected state refers to a state in which the objects are connected with play so that they can more relative to each other to some extent as in the case of using a hole and a pin in a loose-fitted state.

(Positioning Between Printer and Sheet Feeding Unit)

A positioning method between the printer 100 and the sheet feeding unit 200 will be described.

When the printer 100 is mounted on the sheet feeding unit 200, the printer 100 is placed on the sheet feeding unit 200 so that the positioning pins 210*a* and 210*b* of the sheet feeding unit 200 are engaged into the positioning holes 106*a* and 106*b* provided in the bottom plate of the printer 100. The positioning pins and the positioning holes are located in the neighborhoods of longitudinal ends of the recording material delivering portion (opening) and therefore by effecting the positioning at the position, the recording material delivering portion can be positioned with accuracy. Incidentally, the positioning pin and the positioning hole satisfy a dimensional relation of loose fitting (engagement). That is, even when the pin of the sheet feeding unit 200 is inserted into the hole of the printer 100, there is play (minute clearance) between the pin and the hole, so that the printer 100 and the sheet feeding unit 200 are not connected firmly. Although the printer 100 and the sheet feeding unit 200 are not connected firmly, when the printer 100 is moved relative to the sheet feeding unit 200, the pin and the hole interfere with each other, so that the printer 100 is not readily moved (connected state).

Further, the three supporting portions 105*a* to 105*c* of the printer 100 are placed on the associated receiving portions 211*a* to 211*c* of the sheet feeding unit 200. Thus, the printer 100 and the sheet feeding unit 200 are positioned at least at the three points, at two points of which the printer 100 and the sheet feeding unit 200 are positioned by the pins in both end sides of the opening through which the sheet is delivered from the sheet feeding unit 200 to the printer 100. Incidentally, although the positioning is made by the pins, when the pin is firmly engaged (fitted) in the hole, similarly as in the case where the printer 100 and the sheet feeding unit 200 are firmly clamped with the screw, there is a possibility that the frame of the printer 100 is distorted due to the distortion of the frame of the sheet feeding unit 200, thus being undesirable. In order to enhance positioning accuracy of the opening where the recording material is delivered from the sheet feeding unit 200 to the printer 100, at least one of the two supporting portions between which the opening is interposed may preferably be clamped with the screw.

(Clamping Between Printer and Sheet Feeding Unit)

A connecting portion between the sheet feeding unit 200 and the printer 100 will be described.

In the case where the printer 100 is mounted on the sheet feeding unit 200 to constitute the image forming system, it would be considered that the sheet feeding unit and the printer are clamped in order to suppress separation therebetween by external vibration (such as earthquake). However, when the printer 100 and the sheet feeding unit 200 are firmly clamped with a clamping means such as the screw, there is a possibility that the frame of the printer 100 is distorted by the frame distortion of the sheet feeding unit 200. Especially, when two sets or more of beams constituting the frames are clamped, the distortion of the sheet feeding unit 200 is liable to travel to the printer 100.

For that reason, in the image forming system in this embodiment, the printer 100 and the sheet feeding unit 200 are connected (clamped) in the neighborhoods of the front-right-side supporting portion 105*a* and the left side surface-side supporting portion 105*b*, i.e., in the neighborhoods of the disposing points, of the image forming apparatus (FIGS. 6 and 7). Here, distances from the supporting portions 105*a* and 105*c* to the center of gravity G of the image forming apparatus are longer than a distance from the supporting portion 105*b* to the center of gravity G. In this embodiment, at the two points excluding the point of the supporting portion 105*b* closest to the center of gravity G of the printer 100, the printer 100 and the sheet feeding unit 200 are connected. Incidentally, when the printer 100 and the sheet feeding unit 200 are clamped at only one point, they may preferably be clamped at the supporting portion 105*a* remotest from the center of gravity.

In the case where the clamping is made by using the screw, the screw has a screw head and when the screw head is adjacent to the foot for disposition, it becomes difficult to perform a connecting (clamping) operation of the screw in the neighborhood of the foot. For that reason, in view of the connecting operativity, the neighborhood includes the case where the screw is spaced from the foot for disposition by an operation distance (about 50 mm).

FIG. 6 is an enlarged view of the front-right-side connecting portion (clamping portion) of the image forming system. The printer 100 and the sheet feeding unit 200 are clamped by a clamping plate 301 as a front-right-side clamping means of the apparatus. The clamping plate 301 is mounted in the neighborhood of the supporting portion 105*a* and the receiving portion 211*a*. An end portion 301*a* of the clamping plate 301 is configured to be hooked on the front-right strut 207 of the sheet feeding unit, and another end portion of the clamping plate 301 is fixed on the frame of the image forming apparatus main assembly with a screw 302. In order to mount the clamping plate 301 to the printer and the sheet feeding unit, the sheet-feeding cassettes 101*b* and 201*a* are pulled out and then the clamping plate 301 is mounted, and thereafter the clamping plate 301 may be clamped with the screw from the apparatus front side.

Parts (*a*) and (*b*) of FIG. 7 are enlarged views of the connecting portion (clamping portion) in the front-right side of the image forming system. As described above, the printer 100 and the sheet feeding unit 200 are not separated when they are clamped at least at one point. Naturally, in order to realize less separation between the printer and the sheet feeding unit, they may also be clamped at two points (but when they are clamped at three points, an image is distorted).

The reason why the printer and the sheet feeding unit are clamped with the screw in the neighborhood of the supporting portion 105*a*, of the three supporting portions, remotest from the center of gravity G of the printer is that moment acting on a periphery of the center of gravity G of the printer becomes largest when a predetermined force is applied to the neighborhood of the supporting portion 105*a* in an upward direction with respect to the direction of the gravitation.

In the case where the main assembly quakes in the up-down direction by the earthquake or the like, the image forming apparatus main assembly receives a foot with respect to a floating direction from the sheet feeding unit. The three supporting portions receive a smaller load with a distance from the center of gravity of the main assembly and therefore the small-load supporting portion is liable to float in the case where it is subjected to vibration. In this embodiment, the image forming main assembly and the sheet feeding unit are clamped (and connected) in the neighborhoods of the two supporting portions excluding the supporting portion 105*b* closest to the center of gravity and therefore the printer 100 and the sheet feeding unit 200 can be less shifted from each other.

In this embodiment, the printer 100 and the sheet feeding unit 200 were connected in the neighborhood of the supporting portion 105*c* (third supporting portion) while being clamped at one point (the supporting portion 105*a*). Specifically, as shown in (*a*) of FIG. 7, from below the receiving portion 211*c* of the sheet feeding unit, the sheet feeding unit was connected to the printer 100 with a stepped screw 303 in the neighborhood of the supporting portion 105*c* of the printer 100. A length a under head of the stepped screw 303 as the connecting means is longer than a plate thickness of the receiving portion 211*c*. For that reason, in a state in which the printer 100 and the sheet feeding unit 200 are connected with the stepped screw 303, a spacing b is created between the head of the stepped screw 303 and the receiving portion 211*c* ((*a*) of FIG. 7). That is, by connecting the printer and the sheet feeding unit with the stepped screw 303 as the connecting means 303, the printer 100 and the sheet feeding unit 200 can be connected while allowing an attitude change (play) of the printer 100 to some extent.

In the state in which the printer and the sheet feeding unit are connected in the neighborhood of the supporting portion 105*c* by using the stepped screw, the printer can be moved in the direction of gravitation by a distance corresponding to the play but cannot be moved upward with respect to the direction of gravitation by a distance exceeding the distance corresponding to the play. Incidentally, in order to connect the printer and the sheet feeding unit with the stepped screw at the connecting portion, the supporting portion 105*c* and the receiving portion 211*c* which is exposed by removing a left cover 212 shown in (*b*) of FIG. 4 may only be required to be fixed from below toward above with respect to the direction of gravitation.

When the printer 100 and the sheet feeding unit 200 are firmly clamped with screws at three points or more so as not to be separated from each other, the printer frame is distorted by the influence of the distortion of the sheet feeding unit frame. However, even when a plurality of screws are used concentratedly in a relatively narrow range (e.g., about 5 cm×5 cm), the distortion does not readily travel to the frame of the printer, so that the connecting point can be regarded as a single point.

Further, in the case where the main assembly quakes in the horizontal direction, an external force with respect to the horizontal direction is applied to the positioning pins. There is no center of gravity G of the main assembly on a rectilinear line connecting the two positioning pins, and therefore, particularly in the case where the main assembly quakes in the front-rear direction, a large force based on inertia in the left side of the apparatus is applied to the two positioning pins. However, the printer 100 and the sheet feeding unit 200 are connected by the stepped screw at the supporting portion 105*c* and therefore the printer 100 is prevented from moving by a distance exceeding the distance corresponding to the play (clearance) between a diameter portion of the stepped screw 303 and the screw hole 213 of the receiving portion 211*c*. As a result, it is possible to prevent a situation such that the sheet feeding unit and the image forming apparatus main assembly are shifted from each other.

The center of gravity G is located at a position closer to the loose fitting portion (105*b*) by the pin than the clamping portion (in the neighborhood of 105*a*). For that reason, the load is exerted on the side closer to the center of gravity G, and the pin is not disconnected from the hole even in a state in which the printer and the sheet feeding unit are connected by the pin. Therefore, the printer and the sheet feeding unit can be made less separable from each other even when they are not clamped firmly.

3. Inclination of Disposing Surface and Distortion of Printer Frame

A change in attitude of the sheet feeding unit in the case where the disposing surface is not horizontal will be described with reference to FIG. 8. Thereafter, the frame distortion of the printer 100 and the sheet feeding unit 200 connected as described above in this embodiment will be described.

(Relationship Between Disposing Surface and Attitude of Image Forming System)

Depending on a manner of inclination of the disposing surface, an attitude of the image forming system consisting of the printer 100 and the sheet feeding unit 200 is changed as described below.

Parts (A) to (D) of FIG. 8 are sectional views for illustrating which attitude is taken by the image forming system in the case where a height of one of disposing portions where the four casters contact the disposing surface is higher than those of other disposing portions.

As described above, the frame of the sheet feeding unit 200 is strong with respect to the compression in the up-down direction but is not so high with respect to the stiffness in torsion. For that reason, when the height (level) of the disposing surface at only one of the disposing portions is different, the frame in the neighborhood of the portion where the height of the disposing surface for the frame is high is deformed so as to be raised more than at other portions.

Description will be made by diving the case into four cases where either one of the disposing surfaces in the front-right side (A), the rear-right side (B), the front-left side (C) and the rear-left side (D) is higher than those of other disposing surfaces. In (A) to (D) of FIG. 8, "L" shows a left side view of the system, and "R" shows a right side view of the system.

(A) Case where Disposition Height in Front-Right Side is Different

Part (A) of FIG. 8 includes side views for illustrating the attitude of the system in the case where the disposing surface of the caster 203*a* (front-right side) of the sheet feeding unit 200 is higher than those of other casters. Here, when the caster 203*a* is displaced upward by X mm, also the front-right-side receiving portion 211*a* of the sheet feeding unit 200 is displaced upward by approximately X mm. However, the frame of the sheet feeding unit 200 is distorted and therefore the receiving portion 211*b* (rear-right side) and the receiving portion 211*c* (left side) are little displaced with respect to the up-down direction.

For that reason, the system takes an attitude such that the printer 100 is slightly raised in the front-right side with a rectilinear line, as the rotation center, connecting the supporting portions 105*b* and 105*c* of the printer 100.

(B) Case where Disposition Height in Front-Right Side is Different Part (B) of FIG. 8 includes side views for illustrating the attitude of the system in the case where the disposing surface of the caster 203*b* (rear-right side) of the sheet feeding unit 200 is higher than those of other casters. Here, when the rear-right-side caster 203*b* is displaced upward by X mm, also the rear-right-side receiving portion 211*b* of the sheet feeding unit 200 is displaced upward by approximately X mm. However, the frame of the sheet feeding unit 200 is distorted and therefore the receiving portion 211*a* (front-right side) and the receiving portion 211*c* (left side) are little displaced with respect to the up-down direction.

For that reason, the system takes an attitude such that the printer 100 is slightly raised in the rear-right side with a rectilinear line, as the rotation center, connecting the supporting portions 105*a* and 105*c* of the printer 100.

(C) Case where Disposition Height in Front-Left Side is Different

Part (C) of FIG. 8 includes side views for illustrating the attitude of the system in the case where the disposing surface of the caster 203*c* (front-left side) of the sheet feeding unit 200 is higher than those of other casters. Here, a (horizontal) distance from the front-right-side caster 203*c* to the left-side receiving portion 211*c* is l1, and a (horizontal) distance from the rear-left-side caster 203*d* to the left-side receiving portion 211*c* is l2. In such a constitution, when the front-left-side caster 203*c* is displaced upward by X mm, the left-side receiving portion 211*c* of the sheet feeding unit 200 is displaced upward by approximately (X×l1)/(l1+l2) mm. However, the frame of the sheet feeding unit 200 is distorted and therefore the receiving portion 211*a* (front-right side) and the receiving portion 211*b* (rear-right-side) are little displaced with respect to the up-down direction.

For that reason, the system takes an attitude such that the printer 100 is slightly raised in the left side with a rectilinear line, as the rotation center, connecting the supporting portions 105*a* and 105*b* of the printer 100.

(D) Case where Disposition Height in Rear-Left Side is Different

Part (D) of FIG. 8 includes side views for illustrating the attitude of the system in the case where the disposing surface of the caster 203*d* (rear-left side) of the sheet feeding unit 200 is higher than those of other casters. In such a constitution, when the rear-left-side caster 203*d* is displaced upward by X mm, the left-side receiving portion 211*c* of the sheet feeding unit 200 is displaced upward by approximately (X×l2)/(l1+l2) mm. On the other hand, the frame of the sheet feeding unit 200 is distorted and therefore the other receiving portions 211*a* (front-right side) and 211*b* (rear-right-side) are not displaced.

For that reason, the system takes an attitude such that the printer 100 is slightly raised in the left side with a rectilinear line, as the rotation center, connecting the supporting portions 105*a* and 105*b* of the printer 100.

(Print Frame Distortion in Each Attitude in this Embodiment and Comparative Embodiment)

The four cases are described above, but in either case, a rectilinear line connecting contact surfaces of the two receiving portions 211*a* and 211*b* provided in the right side of the sheet feeding unit 200 and a rectilinear line connecting contact surfaces of the supporting portions 105*a* and 105*b* of the main assembly of the printer 100 keep a parallel state. On the other hand, it is understood that an angle of each of a contact surface of the left-side receiving portion 211*c* and a contact surface of the left-side supporting portion 105*c* is changed. In such a situation, bending of the frame of the printer 100 mounted on a top plate of the sheet feeding unit 200 will be compared between this embodiment and Comparative Embodiment.

<Deformation of Printer Frame (Comparative Embodiment)>

As Comparative Embodiment, the case of distortion in a constitution in which the printer 100 and the sheet feeding unit 200 are clamped with screws at four corners will be described. As described above, the frame of the sheet feeding unit is distorted by the influence of the disposing surface. When the distorted sheet feeding unit 200 and the printer 100 are clamped by the screws, the sheet feeding unit top plate of the printer bottom plate are substantially parallel to each other. That is, in the constitution of the screw fixing at the four corners, the frame of the printer 100 receives a force from the screws so as to follow the sheet feeding unit 200, thus being deformed.

<Deformation of Printer Frame (this Embodiment)>

In the image forming system in this embodiment, as shown in FIG. 6, the printer 100 and the sheet feeding unit 200 are clamped by the clamping plate 301. However, the rectilinear line connecting the contact surfaces of the two receiving portions 211*a* and 211*b* provided in the right side of the sheet feeding unit 200 and the rectilinear line connecting the contact surfaces of the supporting portions 105*a* and 105*b* of the printer 100 keep the parallel state. For that reason, even when the sheet feeding unit 200 and the printer 100 are clamped in the neighborhood of the receiving portion 211*a*, the frame of the printer 100 is prevented from being twisted or distorted.

Further, the left side receiving portion of the apparatus is fixed by the stepped screw as shown in (*a*) of FIG. 7. For that reason, the state of the connecting portion in the case where each of the contact surfaces of the receiving portion 211*c* and the supporting portion 105*c* is tilted at an angle is as shown in (*b*) of FIG. 7.

Here, there is the play (clearance) between the screw hole 213 provided in (opened at) the receiving portion 211*c* and the diameter portion under head of the stepped screw 303.

Further, also with respect to the up-down direction, there is the play between the head of the stepped screw 303 and the receiving portion 211*c*. For that reason, a contact region between the supporting portion 105*c* and the receiving portion 211*c* is changed, so that these portions can be inclined relative to each other. For that reason, even when the printer 100 and the sheet feeding unit 200 are connected by the stepped screw 303, by the distortion of the frame of the sheet feeding unit 200, the frame of the main assembly of the printer 100 is not distorted.

That is, in the case where a side (edge), of the bottom of the first unit (printer 100), in a side where the first and second foots are provided is inclined by displacement of the disposing surface of the sheet feeding unit 200 (second unit), the sheet feeding unit 200 and the printer 100 are connected so that a side (edge) in another (opposite) side is not prevented from being inclined correspondingly to the inclination.

As described above, by firmly clamping the printer and the sheet feeding unit by the clamping plate in the front-right side of the apparatus and by connecting the printer and the sheet feeding unit by the stepped screw with the play (clearance) in the left side of the apparatus, even when the image forming system is mounted in a place where the flatness of the floor surface is poor, it is possible to suppress the distortion of the frame of the main assembly of the printer 100. As a result, image defect and improper operation which result from the distortion of the frame of the printer 100 can be prevented. Further, even in the case where the earthquake or the like generates and thus the apparatus quakes, the sheet feeding unit and the printer are prevented from being shifted from each other. Further, in the rear-right side of the apparatus, there is no need to connect the printer main assembly and the sheet feeding unit and therefore the connecting operation between these units can be simply performed only by removing the sheet-feeding cassettes and the left-side outer casing cover.

Incidentally, in this embodiment, description is made by using the example in which the supporting portions are disposed at the three positions consisting of the front-right position, the rear-right portion and the left side surface position, but it is clear that if a similar relationship between the center of gravity of the printer 100 as the image forming apparatus and the supporting portions is satisfied, even when the supporting portions are disposed at other positions, a similar effect can be obtained.

Embodiment 2

A constitution of this embodiment will be described. Portions similar to those in Embodiment 1 will be omitted from description.

Part (*a*) of FIG. 9 is a left side view for illustrating an engaging portion between the printer 100 and the sheet feeding unit 200 (specifically, left-side supporting portion and receiving portion). The left-side supporting portion 105*c* of the apparatus main assembly is divided into two portions provided at two positions close to each other. A recess between the two portions is provided with a tap 107. An interval l between the divided two supporting portions is about 80 mm which is about 1/7 to 1/10 of which is shorter than an interval between the supporting portions 105*a* and 105*c* and an interval between the supporting portions 105*b* and 105*c*, and therefore it can be considered that the two supporting portions 105*c* is regarded as a single supporting portion (clamping point).

Originally, the supporting portions and the receiving portions are required to have strength (stiffness) but in the constitution in this embodiment, there is no need to provide the tap or the hole at the supporting portions or the receiving portions, and therefore it is possible to prevent a lowering in strength. Further, as shown in (*b*) of FIG. 9, at the tap portion, burrs 108 are generated in some cases. In the case where the image forming apparatus main assembly is used alone, in Embodiment 1, there is a possibility that the burrs 108 contact and damage the disposing surface of the desk or the like. In this embodiment, the tap portion is located above the supporting portions 105*c* and therefore an occurrence of such a problem can be obviated.

Embodiment 3

A constitution in this embodiment will be described. Portions similar to those in Embodiments 1 and 2 will be omitted from description.

FIG. 10 is a front view of an image forming system to which the constitution in this embodiment is applied. In this embodiment, different from Embodiments 1 and 2, the frame of the sheet feeding unit has the substantially same width as that of the frame of the image forming apparatus main assembly, and left-side surfaces of both of the units are substantially aligned with each other. Further, the left-side supporting portion 105*c* and the receiving portion 211*c* are clamped by using a clamping plate 304. However, different from clamping with a clamping plate 301 in the front-right side, between the sheet feeding unit and the clamping plate, the play (clearance) is provided with respect to both of the up-down direction and the left-right direction. Further, the clamping in the main assembly side is made by a screw 305.

There is the play between the clamping plate and the sheet feeding unit and therefore even in the case where the flatness of the disposing place of the image forming apparatus is poor, it is possible to obtain an effect similar to that of the stepped screw used in Embodiments 1 and 2. Incidentally, in the constitution in this embodiment, the left-side surface clamping plate is mounted from the outside of the image forming apparatus and therefore there is no need to remove the cover or the like, so that a disposition property is further improved. In this embodiment, the example in which the clamping plate is fixed by the screw in the image forming apparatus main assembly is described but it is clear that a similar effect can be obtained also when the play is provided between the clamping plate and the main assembly and the clamping plate is fixed to the sheet feeding unit by the screw.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 018914/2012 filed Jan. 31, 2012, which is hereby incorporated by reference.

What is claimed is:

1. An image forming apparatus comprising:

a first unit including an image forming unit for forming an image on a recording material;

a first supporting portion for supporting said first unit substantially at three points, wherein said first supporting portion includes a first foot portion which is in a neighborhood of a first side of a bottom of said first unit and which is provided in a first region provided in one end area of the first side, a second foot portion which is in the neighborhood of the first side of the bottom of said first unit and which is provided in a second region provided in the other end area of the first side, and a third foot portion which is in a neighborhood of a second side opposing the first side of the bottom of said first unit and which is provided in a third region provided between the first foot portion and the second foot portion with respect to a direction defined by the first side;

a second unit provided below said first unit with respect to a direction of gravitation;

a second supporting portion, provided at a bottom of said second unit, for supporting said second unit by at least four feet; and a connecting portion, provided at or in a neighborhood of the third foot portion, for connecting said first unit and said second unit so that said first unit is movable relative to said second unit in a horizontal in-plane direction with first predetermined play and so that said first unit is movable relative to said second unit in a vertical direction with second predetermined play.

2. An image forming apparatus according to claim 1, wherein the bottom of said first unit has a substantially rectangular shape, and wherein the first foot portion is provided at a first corner portion of the bottom of said first unit, the second foot portion is provided at a second corner portion of the bottom of said first unit, and the third foot portion is provided in a neighborhood of a central portion of the second side of the bottom of said first unit.

3. An image forming apparatus according to claim 1, further comprising a positioning portion, provided adjacent to the first side, for determining a horizontal position of each of said first unit and said second unit.

4. An image forming apparatus according to claim 1, further comprising a limiting portion, provided in a neighborhood of the first foot portion, for limiting movement of said first unit and said second unit so that said first unit and said second unit are prevented from moving relative to each other by being fixed to one of said first unit and said second unit and by being locked by the other one of said first unit and said second unit.

5. An image forming apparatus according to claim 4, wherein the first foot portion is provided in a position that is more remote than a position of the second foot portion from the center of gravity of said first unit, and wherein said limiting portion is provided in the neighborhood of the first foot portion.

6. An image forming apparatus according to claim 1, wherein the first foot portion and the second foot portion are provided adjacent to both end sides of a conveying path for permitting conveyance of the recording material from said first unit to said second unit.

7. An image forming apparatus according to claim 1, wherein said first unit includes a photosensitive member, forming means for forming a toner image on the photosensitive member, an intermediary transfer belt for conveying the toner image, formed on the photosensitive member, to a transfer position, and a plurality of rollers for stretching the intermediary transfer belt.

8. An image forming apparatus according to claim 1, wherein said connecting portion includes a screw fastened to one of said first unit and said second unit and an engaging hole provided in the other one of said first unit and said second unit, and wherein the screw includes:

a large-diameter portion having a diameter larger than the engaging hole, a fastening portion for being fastened to said first unit or said second unit, and an intermediary portion which is provided between the large-diameter portion and the fastening portion and which is engageable with the engaging hole, wherein the first predetermined play is provided between said intermediary portion and said engaging hole with respect to the horizontal in-plane direction, and the second predetermined play is provided between said large-diameter portion and said engaging hole with respect to the vertical direction.

9. An image forming apparatus according to claim 1, wherein said connecting portion is provided at the third foot portion.

10. An image forming apparatus according to claim 1, wherein the connecting portion connects a lower surface of said first unit with an upper surface of said second unit.

11. An image forming apparatus according to claim 1, wherein the third foot portion includes a first supporting foot for supporting said first unit in the third region and a second supporting foot for supporting said first unit in the third region, and an interval between the first supporting foot and the second supporting foot is (i) larger than 1/10 of an interval between the first foot portion and the second foot portion, and (ii) smaller than 1/7 of the interval between the first foot portion and the second foot portion.

12. An image forming apparatus comprising:

a first unit including an image forming unit for forming an image on a recording material;

a first supporting portion for supporting said first unit substantially at three points, wherein said first supporting portion includes a first foot portion which is in a neighborhood of a first side of a bottom of said first unit and which is provided in a first region provided in one end area of the first side, a second foot portion which is in the neighborhood of the first side of the bottom of said first unit and which is provided in a second region provided in the other end area of the first side, and a third foot portion which is in a neighborhood of a second side opposing the first side of the bottom of said first unit and which is provided in a third region provided between the first foot portion and the second foot portion with respect to a direction defined by the first side;

a second unit provided below said first unit with respect to a direction of gravity;

a second supporting portion, provided at a bottom of said second unit, for supporting said second unit by at least four feet;

a first limiting portion, provided in a neighborhood of the third foot portion, for limiting movement of said first unit and said second unit so that said first unit is movable relative to said second unit in the horizontal in-plane direction and so that said first unit is movable relative to said second unit in the vertical direction with second predetermined play; and a second limiting portion for limiting movement of said first unit and said second unit so that said first unit is movable relative to said second unit in the horizontal in-plane direction with first predetermined play.

* * * * *